United States Patent [19]

Brinkman

[11] Patent Number: 4,910,820

[45] Date of Patent: Mar. 27, 1990

[54] COMBINATION HAMMER AND CASEMENT WINDOW TOOL

[76] Inventor: Richard A. Brinkman, 977 Coventry, NW, Grand Rapids, Mich. 49504

[21] Appl. No.: 356,190

[22] Filed: May 24, 1989

[51] Int. Cl.[4] ..... B25F 1/00

[52] U.S. Cl. ..... 7/138; 7/147

[58] Field of Search ..... 7/147, 146, 143, 138

[56] References Cited

U.S. PATENT DOCUMENTS

D. 156,832 1/1950 Jackson ..... 7/147

1,417,725 5/1922 Fullonwider ..... 7/143

FOREIGN PATENT DOCUMENTS 1049 of 1911 United Kingdom ..... 7/147

*Primary Examiner*—Roscoe V. Parker

*Attorney, Agent, or Firm*—Terry M. Gernstein

[57] ABSTRACT

A combination hammer and casement window opening and closing mechanism operator for use by a framing carpenter includes a head unit having two impact surfaces and a socket in the handle. The socket is used to operate the crank of a casement window opening and closing mechanism, and one of the two impact surfaces is used when the hammer must be used in small, confined areas.

3 Claims, 1 Drawing Sheet

COMBINATION HAMMER AND CASEMENT WINDOW TOOL

TECHNICAL FIELD OF THE INVENTION

The present invention relates to the general art of hand tools, and to the particular field of combination hand tools. Specifically, the present invention relates to a combination tool which can be used by a framing carpenter.

BACKGROUND OF THE INVENTION

A casement window is a hinged window that opens outwardly, and is opened and closed using a crank mechanism. The crank mechanism generally includes a shaft coupled at one end thereof to a gear-like assembly which moves the window as the shaft is rotated. The shaft has teeth on the other end thereof, and these teeth are arranged by a crank which is usually operated by hand to rotate the shaft.

In setting casement windows, a framing carpenter often removes the crank before he begins work, so that it will not become damaged or lost during the framing work.

During the work, the carpenter often has need to open or close the window. However, since the crank has been removed, some inconvenience and delay may be experienced while he searches for the crank, reattaches it, removes it again and then returns it to storage.

Therefore, it would be advantageous to have a ready means for use by a framing carpenter to operate the opening and closing mechanism of a casement window.

While there are many combination tools presently available, such as that tool disclosed in U.S. Pat. No. 743,622, none is directed to the needs of a framing carpenter, and none has means for permitting a framing carpenter to open and close a casement window, nor are they well adapted for use in tight areas which are often encountered by a framing carpenter, or have the elements thereof aligned and oriented to be most useful to a framing carpenter.

Still further, the inventor has found that many situations associated with the placement and installation of casement windows requires maneuvering a hammer in a small, confined space. Such situations may be difficult and frustrating as well as being time consuming. Along this line, the small spaces dictate that the tool cannot have any elements that extend outward from the tool in a manner that may interfere with its use in such small spaces. The tool must also be easily maneuvered in such small areas, and in fact, ease of maneuvering may be a greater requirement in such uses than in normal use of the hammer.

Therefore, there is a need for a combination tool for use by framing carpenters which not only permits him to operate the opening and closing mechanism of a casement window, but will facilitate his work in tight areas often associated with the placement and installation of casement windows.

OBJECTS OF THE INVENTION

It is a main object of the present invention to provide a combination tool for use by framing carpenters.

It is another object of the present invention to provide a combination tool for use by framing carpenters which includes means for opening and closing a casement window.

It is another object of the present invention to provide a combination tool for use by framing carpenters which includes means for opening and closing a casement window using the crank mechanism of that window.

It is another object of the present invention to provide a combination tool for use by framing carpenters which includes means for opening and closing a casement window using the crank mechanism of that window, and which further facilitates his work in confined spaces.

SUMMARY OF THE INVENTION

These, and other, objects are achieved by a hammer that is adapted to use by a framing carpenter that has been provided with a socket in the end of the handle thereof, with that socket including teeth that are sized, shaped and positioned to drivingly engage the teeth on the shaft of a casement window crank mechanism shaft. The socket is located within the perimeter of the handle so that the socket does not interfere with the operation of the tool nor does it upset the balance of the tool during its use. In other words, the tool handle appears to be that of a normal hammer handle in elevational profile.

The hammer is further provided with a second impact surface located on the side of the head so that the head, the handle and the second impact surface all have axes that intersect at the center of gravity of the hammer body.

In this manner, the hammer can be used in spaces that are too small for the head to be maneuvered using the normal impact surface, yet the hammer will be equally as effective in all such applications, and can be used to operate the crank of a casement window without the head unit of the hammer being off center with respect to the axis of rotation of the crank operator. In this manner, the tool can be easily used as a crank operator.

DETAILED DESCRIPTION OF THE PREFERRED EMBODIMENT OF THE INVENTION

Figure 1:
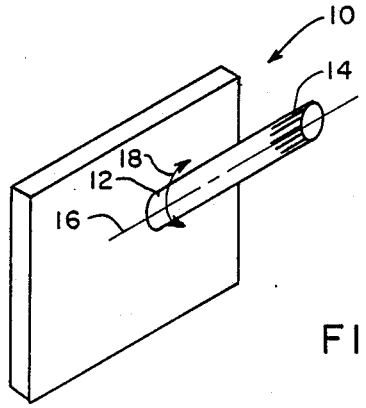
FIG. 1 is a perspective view of a shaft portion of a crank mechanism used to open and close a casement window.

Shown in FIG. 1 is a perspective view of a crank portion 10 of an opening and closing mechanism associated with a casement window. The crank portion 10 includes a shaft 12 that extends outwardly, and has a multiplicity of teeth 14 on one end thereof. These teeth are drivingly engaged by co-operating teeth on a crank element (not shown) to rotate the shaft 12 about the longitudinal axis 16 thereof. Such rotation is imparted to a motion translating system of the opening and closing mechanism, and is translated by that system to opening and closing movement of the window. The details of such mechanism will not be presented herein since those skilled in the art of casement windows will be able to understand what is necessary based on the description presented herein. Shaft rotation is indicated in FIG. 1 by the double-headed arrow 18.

Figure 2:
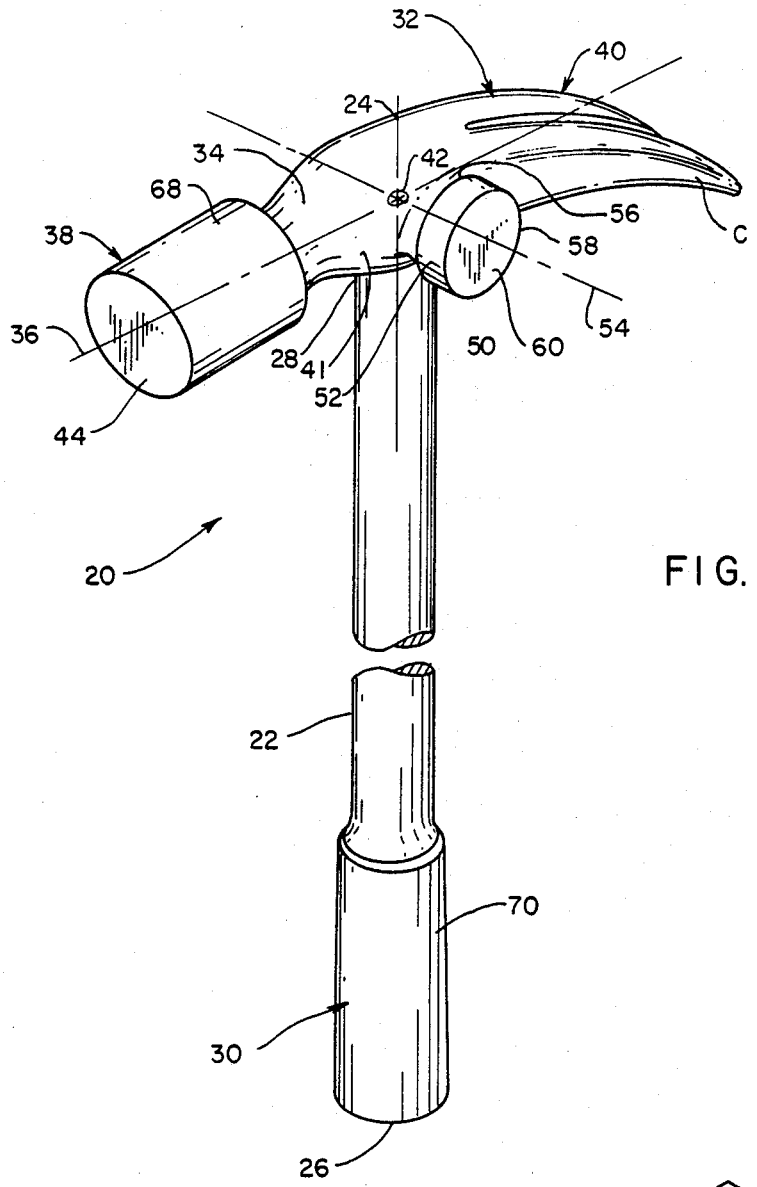
FIG. 2 is a perspective of a combination tool embodying the present invention.

Shown in FIG. 2 is a combination hammer and casement window opening and closing mechanism operator tool 20. This tool 20 can be used by a framing carpenter to open and close a casement window as necessary without need of the crank element of that window, and can be used in small, confined areas.

The tool 20 includes a handle 22 that is elongate and has a longitudinal centerline axis 24. The handle 22 includes a bottom end 26 and a top end 28, with a hand grip element 30 on the handle near the bottom end 26 thereof. The handle can be manufactured of any materials suitable for use in hammers, and can be of any suitable length.

The tool 20 further includes a head unit 32 that is monolithic and formed of any suitable material. The head unit 32 is mounted on the handle at the top end of that handle, and includes a body 34 having a longitudinal centerline 36 extending from a forward end 38 to a rear end 40 of the head 32, and a claw C or the like can be located on the rear end 40. Side surfaces, such as side surface 41, connect the front and rear ends together.

The head body 34 includes a center of gravity 42, and is oriented on the handle so that the head unit longitudinal centerline 36 intersects the handle longitudinal centerline 24 at the body center of gravity 42. This balances the tool when it is being used as a hammer. The head unit body includes a first impact element 44 on the front end 38 of the head body, and which is contained in a first plane.

The tool 20 further includes a second impact element 50 on the head unit body between the first impact element 44 and the claw C. The second impact element 50 is used to hammer items that are located in spaces that are otherwise too small for the hammer to be properly maneuvered to use the first impact element 44. The second impact element 50 includes an elongated body 52 having a longitudinal axis 54 that intersects the intersecting axes 24 and 36 at the center of gravity 42. In this manner, the hammer will be equally balanced whether it is being used with the first impact element 38 or with the second impact element 50. The carpenter thus need not sacrifice any advantages of the hammer in order to use it in a small, confined space.

The second impact element 50 includes a proximal end 56 joined to the body 34 of the head at the side surface 41 so that the entire unit is monolithic for strength, and a distal end 58 on which an impact surface 60 is located. The impact surface 60 is located in a second plane that is oriented at perpendicular to the plane containing the impact surface 44.

Figure 3:
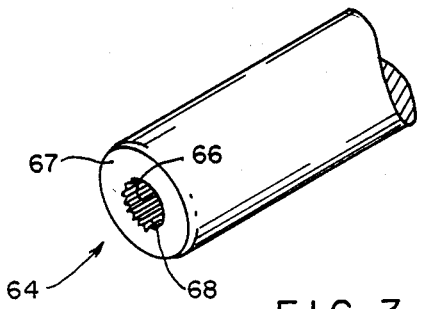
FIG. 3 is a perspective of the lower end of a handle portion of the tool showing the socket of the combination tool of the present invention.

Referring to FIG. 3, it is seen that the tool 20 further includes a socket element 64. The socket element 64 includes a cylindrical bore 66 having a longitudinal axis that is aligned with the handle longitudinal axis 24 and to have a length dimension that exceeds its diameter. The bore 66 is centrally located in the bottom end 26, and thus the bottom end forms an annular surface 67 surrounding the bore. This annular surface can abut a surface adjacent to the shaft 12 so that the tool 20 can be securely and firmly seated during the rotation thereof about the longitudinal axis 24 during a crank actuating motion.

The socket element 64 further includes a multiplicity of teeth 68 on the handle in the bore and which extend along the longitudinal axis of the bore for essentially the entire length of that bore to be parallel to the longitudinal axis 24. The teeth 66 are sized and arranged to accommodate the teeth 14 of the crank element to drivingly, yet releasably, engage those teeth 14 to operate the opening and closing mechanism of the window.

To uses the tool 20 to open or close a casement window, the bore of the socket need only be placed over the crank 12 with the teeth 68 in driving engagement with the teeth 14, and the tool 20 rotated about its longitudinal centerline 24 which has been aligned with the longitudinal centerline 16 of the crank. Such rotation will actuate the crank mechanism to open or close the window.

By having the head unit located as above described with the longitudinal axes intersecting at the center of gravity 42, when the tool is used as a crank operator with the head unit in the carpenter's hand, the tool is balanced so that it is easily used and does not have any force moments tending to interfere with the operation of the tool as a crank operator, and the tool will be aligned with the crank in a manner to operate even windows that are stuck as the moments and forces will be aligned in the most effective manner.

By having the socket element recessed into the handle, that element will not interfere with the operation of the tool in its other capacities, especially if that tool has to be maneuvered in small areas.

The tool 20 can also include a cover element 68 on the front end of the head body, and a cover element 70 on the handle near the bottom.

It is understood that while certain forms of the present invention have been illustrated and described herein, it is not to be limited to the specific forms or arrangements of parts described and shown.

I claim:

1. A combination hammer and casement window opening and closing mechanism operator for use by a framing carpenter comprising:

(A) a handle having a longitudinal axis, a bottom end and a top end;

(B) a casement window crank operating socket in said handle, said socket including (1) a cylindrical bore defined in said handle to extend from said handle bottom end along said handle longitudinal axis and being elongated to have a length dimension that is greater than a diameter dimension, said bore extending into said handle and being located approximately centrally of said handle bottom end, (2) an annular abutting surface on said bottom end surrounding said bore, (3) a multiplicity of teeth on said handle and being located in said bore, said teeth being elongated and extending parallel to said handle longitudinal axis for essentially the entire length of said bore and being sized, arranged and spaced to be releasably and drivingly connected to teeth associated with a casement window opening and closing mechanism crank; and (C) a monolithic head unit on said handle top end and including (1) a body having a center of gravity, a longitudinal axis which is oriented to be perpendicular to said handle longitudinal axis, a forward end, a rear end and side surfaces connecting said forward and rear ends, (2) a first impact element on said body forward end and having an impact surface located in a first plane, (3) a claw element on said body rear end, and (4) a second impact element on said body, said second impact element including (a) an elongated body element located between said body front and rear ends and having (1) a longitudinal axis oriented to intersect said handle longitudinal axis and said head body longitudinal axis at said body center of gravity, (2) a proximal end joined to said head body at one side surface of said side surfaces, and (3) a distal end oriented in a second plane that is perpendicular to the first plane containing said first impact element impact surface, said distal end being spaced from said hammer body head one side surface.

2. The combination hammer defined in claim 1 further including a cover element on said body front end.

3. The combination hammer defined in claim 2 further including a second cover element on said handle near said handle bottom.

* * * * *